US009345925B2

(12) United States Patent
Liu

(10) Patent No.: US 9,345,925 B2
(45) Date of Patent: May 24, 2016

(54) FLOOR-STRETCHING EXERCISE MAT WITH MOVEMENT GUIDING FUNCTION

(71) Applicant: SR TECHNOLOGY CO., LTD., Taichung (TW)

(72) Inventor: Hong-Mao Liu, Taichung (TW)

(73) Assignee: SR Technology Co., Ltd., Taichung (TW)

( * ) Notice: Subject to any disclaimer, the term of this patent is extended or adjusted under 35 U.S.C. 154(b) by 0 days.

(21) Appl. No.: 14/721,719

(22) Filed: May 26, 2015

(65) Prior Publication Data

US 2015/0251046 A1 Sep. 10, 2015

Related U.S. Application Data

(63) Continuation-in-part of application No. 14/065,112, filed on Oct. 28, 2013, now abandoned.

(51) Int. Cl.

| | |
|---|---|
| ***A47G 9/06*** | (2006.01) |
| ***A63B 21/00*** | (2006.01) |
| ***A63B 6/00*** | (2006.01) |
| ***A63B 23/00*** | (2006.01) |
| *A47G 9/00* | (2006.01) |
| *A63B 71/06* | (2006.01) |

(52) U.S. Cl.

CPC ..... *A63B 21/1473* (2013.01); *A47G 9/06* (2013.01); *A47G 9/062* (2013.01); *A63B 6/00* (2013.01); *A63B 21/4037* (2015.10); *A63B 23/00* (2013.01); *A47G 2009/005* (2013.01); *A47G 2200/08* (2013.01); *A63B 71/0622* (2013.01); *A63B 2023/006* (2013.01); *A63B 2071/0625* (2013.01); *A63B 2207/02* (2013.01); *A63B 2210/50* (2013.01); *A63B 2220/806* (2013.01); *A63B 2225/20* (2013.01); *A63B 2225/50* (2013.01)

(58) Field of Classification Search

CPC ..... A47G 2009/005; A47G 2009/006; A47G 9/06; A47G 9/062; A47G 2200/08; A47G 2200/085

USPC ..... 273/237, 238, 287, 440–456, 459, 460

See application file for complete search history.

(56) References Cited

U.S. PATENT DOCUMENTS

| | | | | |
|---|---|---|---|---|
| 8,444,294 | B1 * | 5/2013 | Hawkins | A47G 27/0212 362/100 |
| 2008/0118671 | A1 * | 5/2008 | Bienkiewicz | A47C 27/001 428/12 |
| 2010/0016125 | A1 | 1/2010 | Bellandi | |
| 2012/0233772 | A1 * | 9/2012 | Wang | A47G 27/0237 5/417 |
| 2014/0009916 | A1 * | 1/2014 | Zhang | F21V 33/0004 362/103 |

* cited by examiner

*Primary Examiner* — David E Sosnowski

(74) *Attorney, Agent, or Firm* — Wang Law Firm, Inc.

(57) ABSTRACT

A floor-stretching exercise mat with movement guiding function includes a base board plural guiding mats and a cushion mat. The base board is reconfigurable between a folded and an unfolded configuration and includes plural plates pivoted to one another by pivot connecting members. The plates each include a chamber and plural pivot portion. The pivot connecting members are each pivotally connected between every two plates and include a connecting portion to be pivotally connected to a corresponding one of the pivot portions. The guiding mats are disposed in the chamber and each includes plural display modules which are capable of producing light by contact pressure. The cushion mat is laid on the base board which is in an unfolded configuration to cover the guiding mats and includes plural light-passing apertures aligned with the display modules. The base board is foldable for easy storage and transportation.

3 Claims, 8 Drawing Sheets

FLOOR-STRETCHING EXERCISE MAT WITH MOVEMENT GUIDING FUNCTION

This application is a continuation in part of U.S. patent application Ser. No. 14/065,112, which claims the benefit of the earlier filing date of Oct. 28, 2013, the entire specification of which is incorporated herein by reference.

BACKGROUND OF THE INVENTION

1. Field of the Invention

The present invention relates to a floor-stretching exercise mat, and more particularly to a floor-stretching exercise mat with movement guiding function.

2. Description of the Prior Art

In order to reduce impact and enhance comfortableness during yoga or Pilates exercise, people usually put an elastic mat on the floor and do exercise on the mat.

Besides, incorrect body postures would cause injury, therefore, floor-stretching exercise mats with movement guiding function have been invented. For example, U.S. Publication No. 2010/0016125 discloses such a floor-stretching mat with movement guiding function, the user can follow the instruction of the guiding portions displayed on the guiding mat to perform the movement more close to the standard movement posture, so as to prevent incorrect-body-posture caused injury.

However, the floor-stretching mat disclosed in the U.S. Publication No. 2010/0016125 is relatively large and not foldable, and therefore is quite space consuming and inconvenient for transportation.

The present invention has arisen to mitigate and/or obviate the afore-described disadvantages.

SUMMARY OF THE INVENTION

The primary objective of the present invention is to provide a floor-stretching exercise mat with movement guiding function, which can be folded for easy storage and transportation.

To achieve the above objective, a floor-stretching exercise mat in accordance with the present invention comprises: a base board being reconfigurable between a folded and an unfolded configurations, and including a plurality of plates pivoted to one another by a plurality of pivot connecting members, each of the plates including a chamber, and a plurality of pivot portions, each of the pivot connecting members being pivotally connected between every two said neighboring plates and including a connecting portion to be pivotally connected to a corresponding one of the pivot portions; a plurality of guiding mats disposed in the chambers of the plates, and each including a plurality of display modules which are capable of producing movement guiding light by contact pressure; and a cushion mat being laid on the base board which is in an unfolded configuration to cover the guiding mats, and including a plurality of light-passing apertures aligned with the display modules.

Preferably, a water-resistant layer which is light permeable and disposed between the base board and the cushion mat.

Preferably, a water-resistant layer which is light permeable and disposed on the cushion mat.

Preferably, at least two positioning protrusions are formed in the chamber of one of the plates, one of the guiding mats is provided with positioning holes for insertion of the positioning protrusions, and the cushion mat is also provided with engaging holes for insertion of the positioning protrusions.

Preferably, a pivot is disposed between the pivot portions of the respective plates and the connecting portion of the pivot connecting members.

Preferably, the guiding mats each include a light emitting element and a press portion which is pressed to control the light emitting element, and the light-passing apertures are aligned with the light emitting elements to allow the movement guiding light produced by the light emitting elements to be seen through the light-passing apertures.

DETAILED DESCRIPTION OF THE PREFERRED EMBODIMENTS

Figure 1:
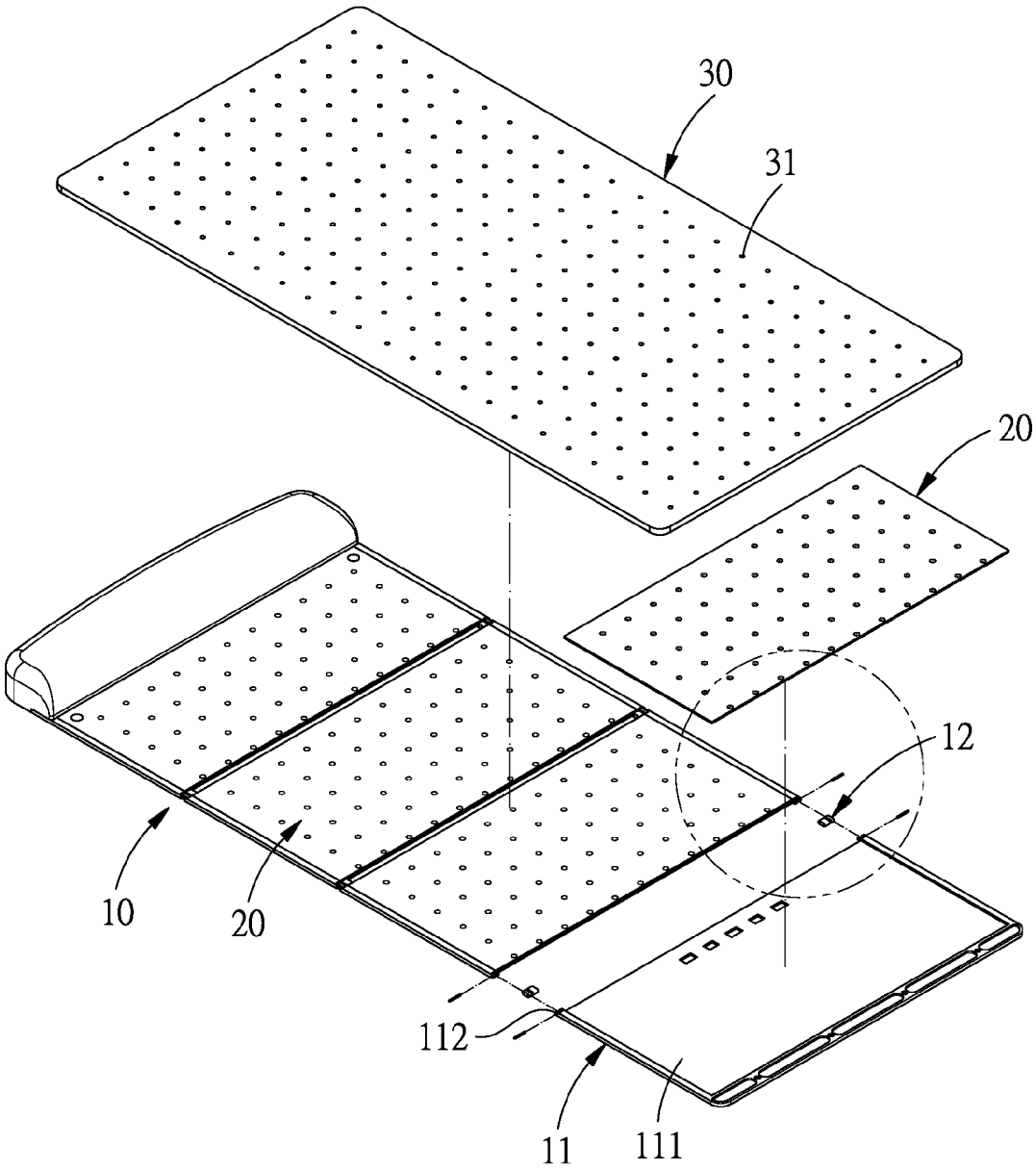
FIG. 1 is an exploded view of a floor-stretching exercise mat with movement guiding function in accordance with a first embodiment of the present invention.

The present invention will be clearer from the following description when viewed together with the accompanying drawings, which show, for purpose of illustrations only, the preferred embodiment in accordance with the present invention.

Referring to FIGS. 1-4, a floor-stretching exercise mat with movement guiding function in accordance with a first embodiment of the present invention comprises: a base board 10, four guiding mats 20, and a cushion mat 30.

The base board 10 is reconfigurable between a folded and an unfolded configurations, and includes four plates 11 which are pivoted to one another by a plurality of pivot connecting members 12. Each of the plates 11 includes a chamber 111, and a plurality of pivot portions 112. Each of the pivot connecting members 12 is pivotally connected between every two neighboring plates 11 and includes a connecting portion 121 to be pivotally connected to a corresponding one of the pivot portions 112. In this embodiment, each of the pivot portions 112 is provided with a first pivot hole 113, the connecting portion 121 of each of the pivot connecting members 12 is provided with a second pivot hole 122, then a pivot 13 is disposed between the pivot portions 112 of the respective plates 11 and the connecting portion 121 of the pivot connecting members 12 to insert through the first and second pivot holes 113, 122, so that the four plates 11 are pivotally connected to one another.

The four guiding mats 20 are disposed in the chambers 111 of the four plates 11, and each include a plurality of display modules 21 which can produce movement guiding light by contact pressure to guide the user. In this embodiment, the guiding mats 20 are fixed in the chambers 11 of the plates 11, and each include a light emitting element 211 and a press portion 212 which can be pressed to control the light emitting element 211.

The cushion mat 30 is laid on the base board 10 which is in an unfolded configuration to cover the guiding mats 20, and includes a plurality of light-passing apertures 31 aligned with the display modules 21 to enhance comfortableness when the user is doing exercise while allowing the user to see the display modules 21. In this embodiment, the light-passing apertures 31 are aligned with the light emitting elements 211, so that the movement guiding light produced by the light emitting elements 211 can be seen through the light-passing apertures 31.

What mentioned above are the structural relations of the main components of the first embodiment of the present invention, and the operation and function of the present invention are to be described as follows.

Figure 2:
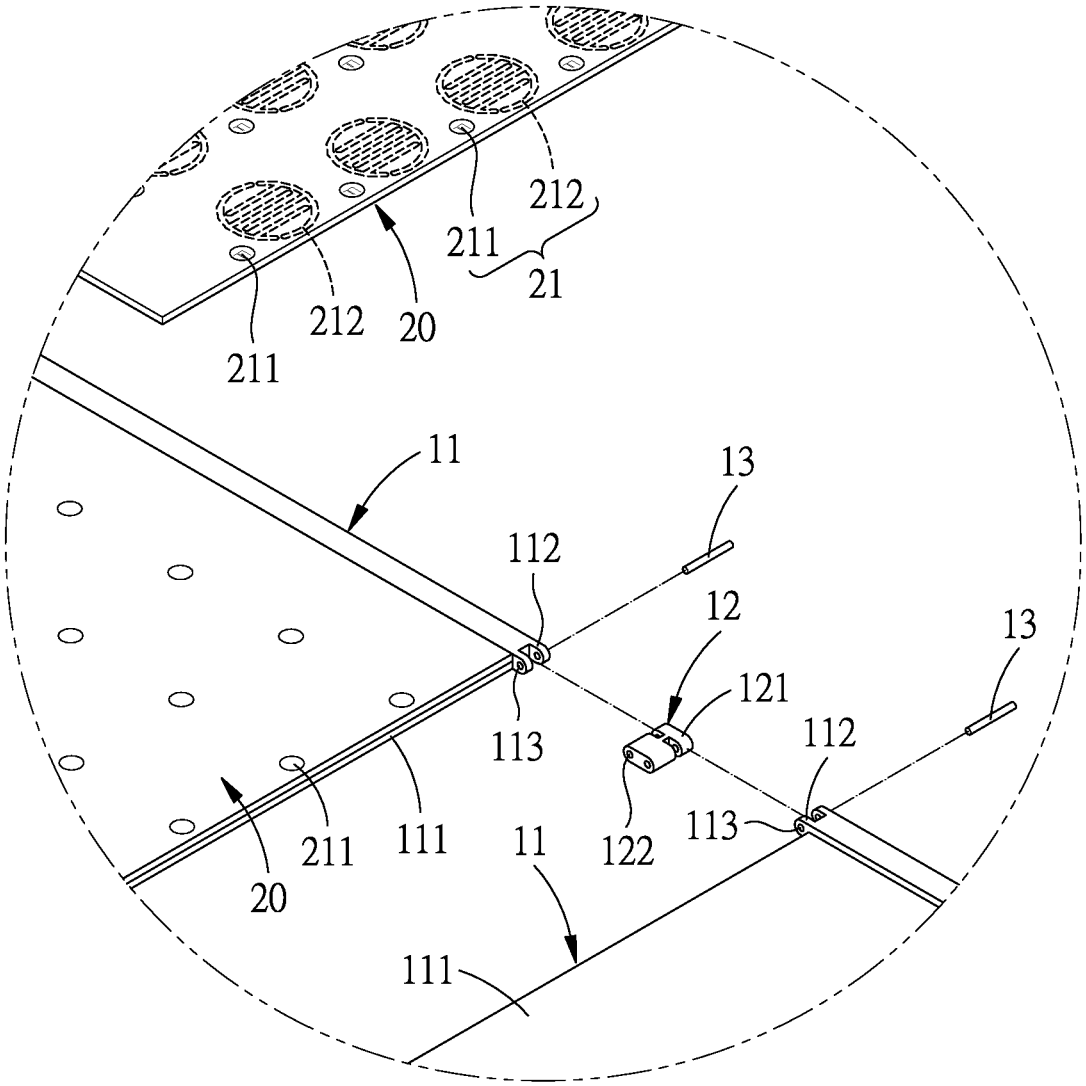
FIG. 2 is a magnified view of a part of FIG. 1.
Figure 3:
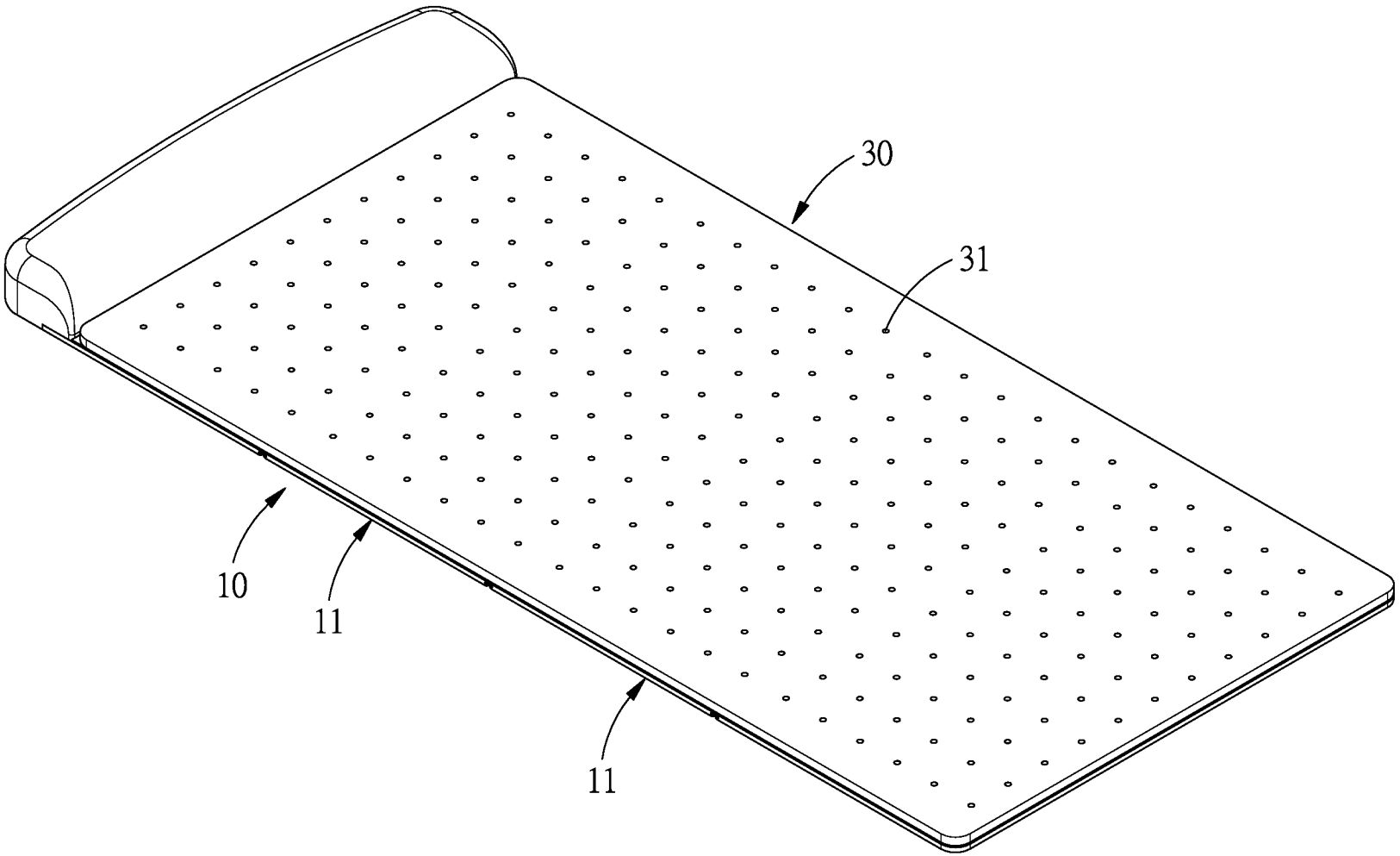
FIG. 3 is an assembly view of the floor-stretching exercise mat with movement guiding function in accordance with the first embodiment of the present invention, wherein the base board is in an unfolded state.

To unfold the base board 10 to an unfolded configuration, as shown in FIGS. 2 and 3, the plates 11 can be pivoted about the pivot connecting members 12 by a certain angle until the plates 11 are located at the same level, so that the base board 10 is unfolded to the unfolded state. Then, the assembly is finished by laying the cushion mat 30 on the unfolded base board 10 to cover the guiding mats 20. By such arrangements, the movement guiding light produced by the display modules 21 of the guiding mats 20 can be seen through the cushion mat 30, and when the press portion 212 of the display modules 21 is pressed, the light emitting element 211 will produce movement guiding light which can be seen through the light-passing apertures 31, so that the user can move properly by following the guidance of the movement guiding light, so as to prevent the injury caused by incorrect body postures.

Figure 4:
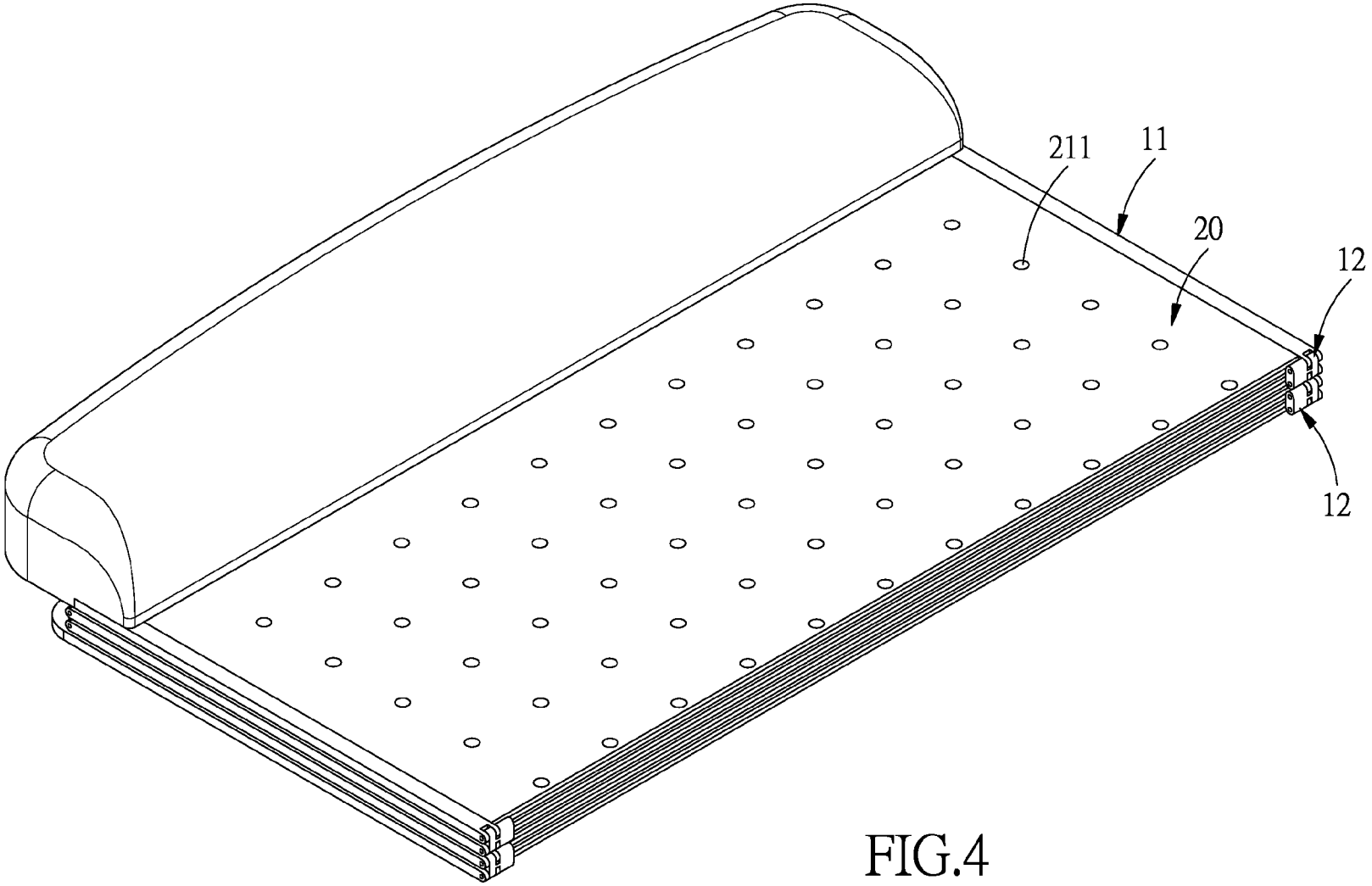
FIG. 4 is an assembly view of the floor-stretching exercise mat with movement guiding function in accordance with the first embodiment of the present invention, wherein the base board is in a folded state.

The folded configuration of the base board 10, as shown in FIGS. 2-4, the cushion mat 30 can be removed from the base board 10, and then the plates 11 can be pivoted about the pivot connecting members 12 a certain angle until the plates 11 are stacked one on top of another for easy storage and transportation. The cushion mat 30 which has been removed from the base board 10 can also be rolled up into a cylinder for easy storage or transportation.

Figure 5:
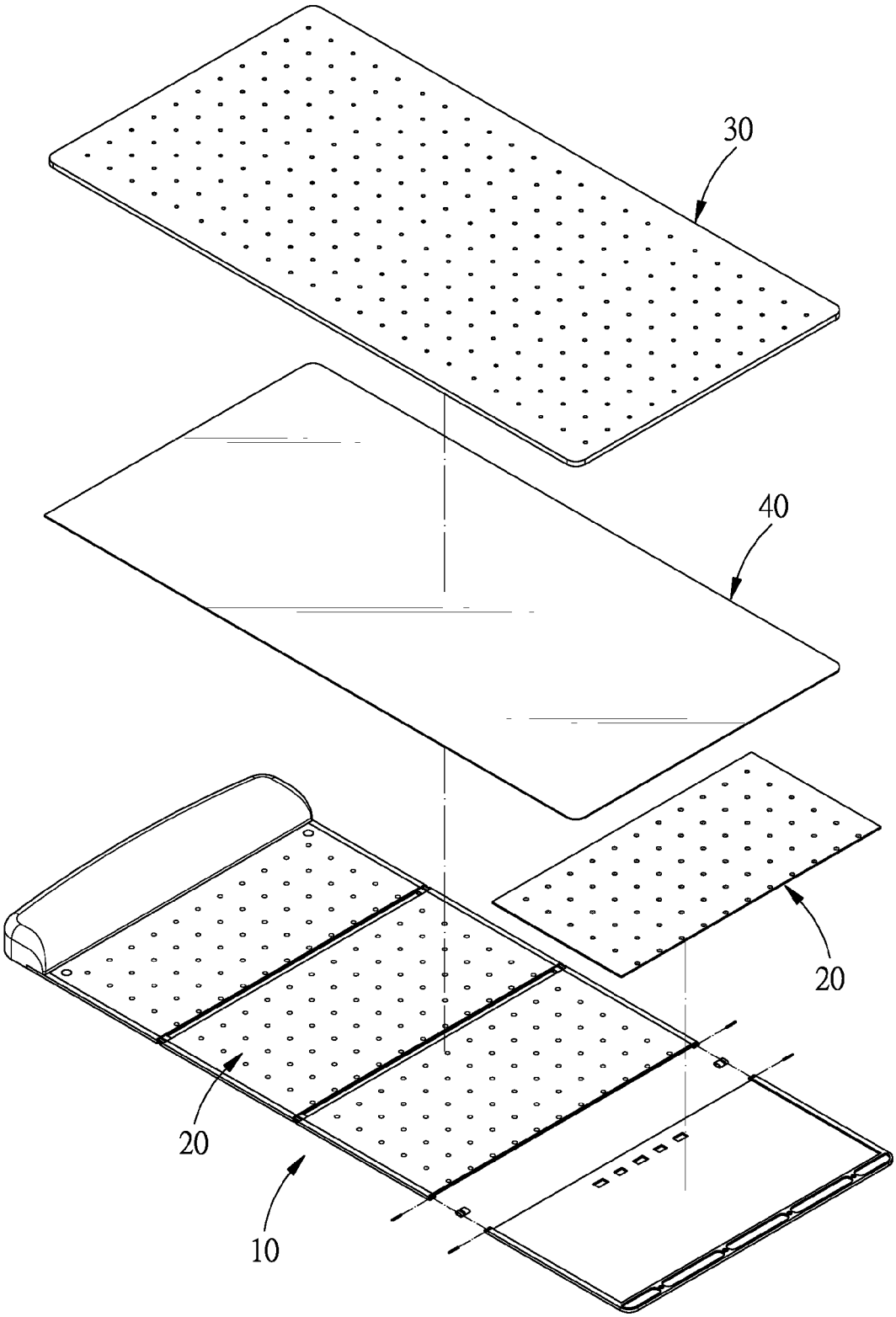
FIG. 5 is an exploded view of a floor-stretching exercise mat with movement guiding function in accordance with a second embodiment of the present invention.

Referring then to FIG. 5, a floor-stretching exercise mat with movement guiding function in accordance with a second embodiment of the present invention is similar to the first embodiment, except that: it further comprises a water-resistant layer 40 which is light permeable and disposed between the base board 10 and the cushion mat 30 to cover the guiding mats 20 and prevent user's perspiration from wetting and soiling the guiding mats 20.

Figure 6:
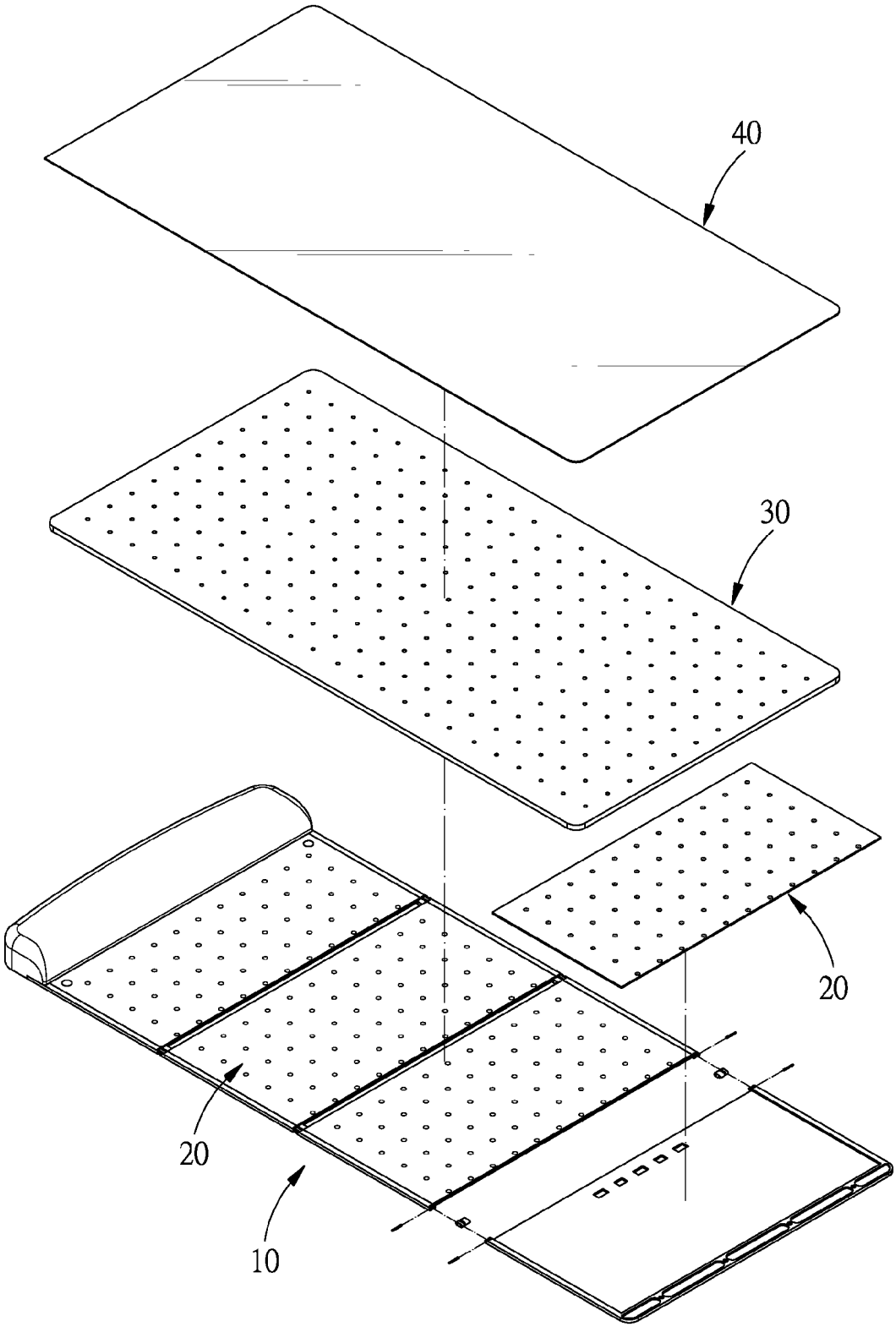
FIG. 6 is an exploded view of a floor-stretching exercise mat with movement guiding function in accordance with a third embodiment of the present invention.

Referring then to FIG. 6, a floor-stretching exercise mat with movement guiding function in accordance with a third embodiment of the present invention is similar to the first embodiment, except that: it further comprises a water-resistant layer 40 which is light permeable and disposed on the cushion mat 30. Since the cushion mat 30 is laid on the base board 10 which has been spread out in an unfolded state and covers the guiding mats 20, the water-resistant layer 40 can also cover the guiding mats 20 to prevent user's perspiration from wetting and soiling the guiding mats 20.

Figure 7:
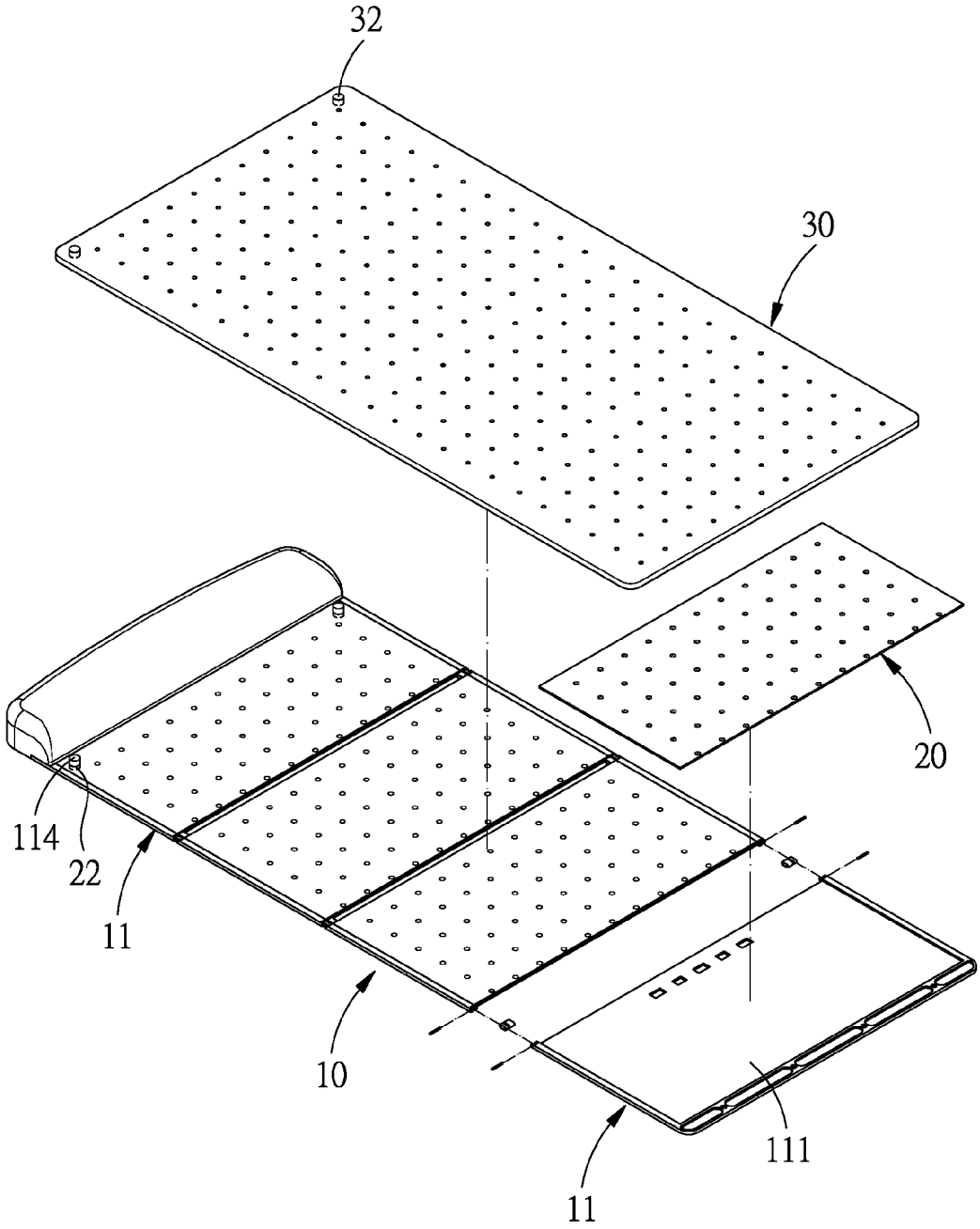
FIG. 7 is an exploded view of a floor-stretching exercise mat with movement guiding function in accordance with a fourth embodiment of the present invention.
Figure 8:
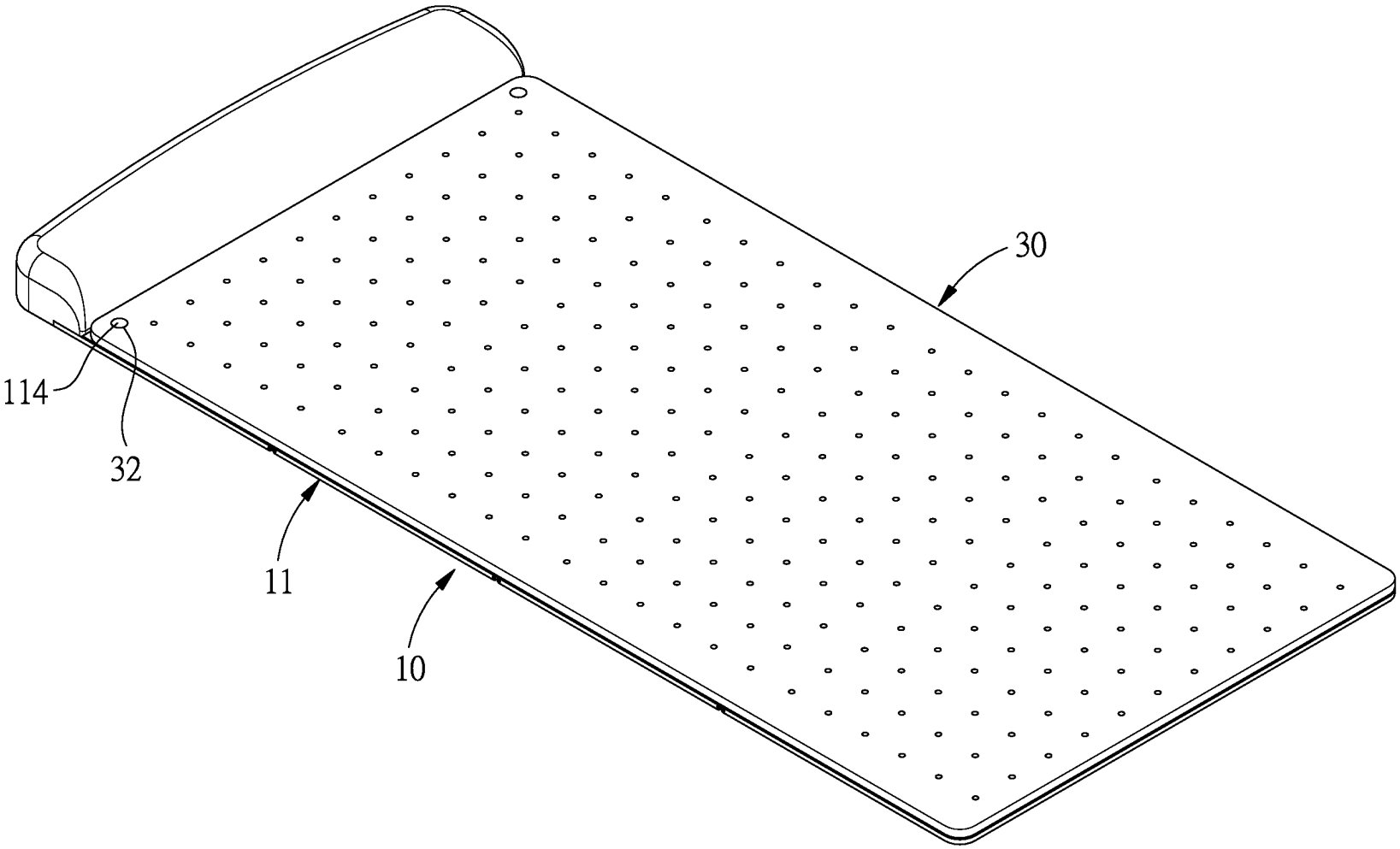
FIG. 8 is an assembly view of a floor-stretching exercise mat with movement guiding function in accordance with a first embodiment of the present invention.

Referring then to FIGS. 7 and 8, a floor-stretching exercise mat with movement guiding function in accordance with a fourth embodiment of the present invention is similar to the first embodiment, except that: in the chamber 111 of one of the plates 11 are disposed two positioning protrusions 114, one of the guiding mats 20 is provided with two positioning holes 22 for insertion of the positioning protrusions 114, and the cushion mat 30 is also provided with two engaging holes 32 for insertion of the positioning protrusions 114. In this embodiment, the two positioning protrusions 114 are located at the first one of the four plates 11, and the positioning holes 22 are formed on the first one of the four guiding mats 20. Of course, the positioning protrusions 114 can also be located at the last one or an arbitrary one of the four plates 11, and the positioning holes 22 and engaging holes 32 are located in alignment with the positioning protrusions 114.

Since the cushion mat 30 is laid on the base board 10 which has been spread out in an unfolded state and covers the guiding mats 20, when the positioning protrusions 114 of the base board 10 are inserted in the engaging holes 32 of the cushion mat 30, the cushion mat 30 can be stably positioned with respect to the base board 10 and can cover the guiding mats 20. As a result, when the user is doing exercise on the cushion mat 30, the misalignment, which is likely to occur between the cushion mat 30 and the guiding mats 20 and stops the movement guiding light from being seen through the light-passing apertures 31, can be prevented.

While we have shown and described various embodiments in accordance with the present invention, it is clear to those skilled in the art that further embodiments may be made without departing from the scope of the present invention.

What is claimed is:

1. A floor-stretching exercise mat with movement guiding function comprising:

a base board being reconfigurable between a folded and an unfolded configuration, and including a plurality of plates pivotably connected to one another by a plurality of pivot connecting members, each of the plates including a chamber and a plurality of pivot portions, each of the pivot connecting members being pivotally connected between two neighboring plates of said plurality of plates and including a connecting portion pivotally connected to a corresponding one of the pivot portions;

a plurality of guiding mats disposed in the chambers of the plates, and each including a plurality of display modules which are configured to produce movement guiding light in response to contact pressure; and a cushion mat laid on the base board which is in the unfolded configuration to cover the guiding mats, and including a plurality of light-passing apertures aligned with the display modules.

2. The floor-stretching exercise mat with movement guiding function as claimed in claim 1, wherein a pivot is disposed between each of the pivot portions and through the connecting portions of the pivot connecting members.

3. The floor-stretching exercise mat with movement guiding function as claimed in claim 1, wherein the display modules each include a press portion and an associated light emitting element controlled by said press portion, wherein the light emitting elements produce the movement guiding light, and the light-passing apertures are aligned with the light emitting elements to allow the movement guiding light to be seen through the light-passing apertures.

* * * * *